US005449364A

United States Patent [19]

Niedertscheider et al.

[11] Patent Number: 5,449,364

[45] Date of Patent: Sep. 12, 1995

[54] DISC-TYPE DEPILATION APPARATUS WITH PLAY-FREE SHAFT COUPLING

[75] Inventors: Reinhard J. Niedertscheider; Franciscus M. J. Van Roemburg; Günther F. Schmid, all of Klagenfurt, Austria

[73] Assignee: U.S. Philips Corporation, New York, N.Y.

[21] Appl. No.: 227,866

[22] Filed: Apr. 14, 1994

Related U.S. Application Data

[63] Continuation of Ser. No. 941,480, Sep. 8, 1992, abandoned.

[30] Foreign Application Priority Data

Sep. 10, 1991 [EP] European Pat. Off. ..... 91202300

[51] Int. Cl.[6] ..... A45D 26/00

[52] U.S. Cl. ..... 606/133; 606/131

[58] Field of Search ..... 606/131, 133, 1; 452/82–84, 71

[56] References Cited

U.S. PATENT DOCUMENTS

| | | | |
|---|---|---|---|
| 1,875,980 | 9/1932 | Bingham . | |
| 1,923,415 | 8/1933 | Bingham . | |
| 2,788,651 | 4/1957 | Qwarnstrom . | |
| 2,900,661 | 8/1959 | Schnell . | |
| 3,468,141 | 9/1969 | Soleanicov et al. . | |
| 3,608,153 | 9/1971 | Berrett . | |
| 3,911,530 | 10/1975 | Kalfsbeck et al. . | |
| 4,079,741 | 3/1978 | Daar et al. . | |
| 4,279,253 | 7/1981 | Haes et al. . | |
| 4,575,902 | 3/1986 | Alazet . | |
| 4,726,375 | 2/1988 | Gross et al. . | |
| 4,807,624 | 2/1989 | Gross et al. . | |
| 4,830,004 | 5/1989 | Alazet . | |
| 4,935,024 | 6/1990 | Dolev | 606/133 |
| 4,960,422 | 10/1990 | Demeester . | |
| 5,041,123 | 8/1991 | Oliveau et al. | 606/133 |
| 5,108,410 | 4/1992 | Inasaki et al. | 606/133 |
| 5,112,341 | 5/1992 | Doley | 606/133 |
| 5,171,315 | 12/1992 | Cabrero | 606/131 |
| 5,190,559 | 3/1993 | Gabion et al. | 606/133 |
| 5,196,021 | 3/1993 | Kabla | 606/131 |
| 5,197,969 | 3/1993 | Visscher et al. | 606/131 |

FOREIGN PATENT DOCUMENTS

| | | | |
|---|---|---|---|
| 0373032 | 6/1990 | European Pat. Off. | 606/133 |
| 0467733 | 1/1992 | European Pat. Off. | 606/133 |
| 788130 | 7/1935 | France . | |
| 943472 | 3/1949 | France . | |
| 2556939 | 6/1985 | France . | |
| 1121291 | 1/1962 | Germany . | |
| 420470 | 12/1934 | United Kingdom . | |
| 461572 | 2/1937 | United Kingdom . | |

*Primary Examiner*—Stephen C. Pellegrino
*Assistant Examiner*—Glenn Dawson
*Attorney, Agent, or Firm*—Ernestine C. Bartlett

[57] ABSTRACT

A depilation apparatus comprising a number of pinching discs (39, 119, 143) which are coupled to a drive shaft (7, 145) by means of a coupling member (43, 123, 155) and which are pivotable by means of a pivot member (87, 89) about a pivot axis (115, 141) extending transverse to the drive shaft (7, 145) into a pinching position in which the pinching discs (39, 119, 143) exert a pinching force on one another near a depilation opening (3). The coupling members (43, 123, 155) are each provided with a rotund pivot guide (45, 125, 153), so that the pinching discs (39, 119, 143) are coupled to the drive shaft (7, 145) substantially without play in a radial direction in any position. In a special embodiment, the drive shaft (7) is provided with three parallel rods (11) and the coupling member (43) is arranged between the rods (11), whereby the coupling member (43) bears on each rod (11) with a lateral surface which forms part of a spherical surface tangent to each rod (11). Due to the use of the coupling members (43, 123, 155), the pinching discs (39, 119, 143) have a high degree of tilting freedom relative to the drive shaft (7, 145) and are coupled to the drive shaft (7, 145) without play in any tilting position.

15 Claims, 8 Drawing Sheets

DISC-TYPE DEPILATION APPARATUS WITH PLAY-FREE SHAFT COUPLING

This is a continuation of application Ser. No. 07/941,480, filed Sep. 8, 1992, now abandoned.

FIELD OF THE INVENTION

The invention relates to a depilation apparatus having at least two cooperating pinching discs which are coupled to a drive shaft which is rotatable relative to a housing and which extends parallel to a depilation opening of the housing, at least one of the pinching discs being pivotable by means of a pivot member about a pivot axis directed transverse to the drive shaft into a pinching position in which the pinching discs exert a pinching force on one another near the depilation opening.

BACKGROUND OF THE INVENTION

A depilation apparatus of the kind mentioned in the opening paragraph is known from U.S. Pat. No. 4,960,422. The pinching discs of the known depilation apparatus are pivotable by means of a number of sliding bars, which bars are displaceable along the drive shaft, and alternately enter the pinching position with the two adjoining pinching discs. Hairs present in the depilation opening are thus pinched between the pinching discs and pulled from the skin by the rotation of the drive shaft. The pinching discs are provided with a polygonal central opening by means of which the pinching discs are passed over the drive shaft and the sliding bars with clearance, and are spaced apart in an axial direction in wedge-shaped grooves which at the same time define the pivot axes of the pinching discs. The extent of the clearance of the pinching discs around the drive shaft is determined by the value of the angle through which the pinching discs are pivoted about the pivot axes in the pinching position.

A disadvantage of the known depilation apparatus is that the pinching discs are arranged loosely in radial direction around the drive shaft because of the clearance required for the pivoting movement. The clearance leads to undesirable displacements of the pinching discs in radial directions during rotation of the drive shaft, which may cause wear of the pinching discs and the drive shaft as well as rattling noises of the depilation apparatus.

SUMMARY OF THE INVENTION

It is an object of the invention to provide a depilation apparatus of the kind mentioned in the opening paragraph in which the radial play of the pinching discs relative to the drive shaft is prevented as much as possible, while nevertheless the pinching discs have a high degree of tilting freedom relative to the drive shaft.

The invention is for this purpose characterized in that the pivotable pinching disc is supported in a direction transverse to the drive shaft by means of a rotund pivot guide of a coupling member by which the pinching disc is coupled to the drive shaft. As a result of the use of the coupling member with the rotund pivot guide, the pinching disc is coupled to the drive shaft substantially without play in radial directions in every position. The said coupling member is particularly advantageous when comparatively great tilting angles of the pinching disc occur.

A particular embodiment of the depilation apparatus according to the invention, in which the coupling member itself permits a pivoting movement of the pinching disc about every pivot axis directed transverse to the drive shaft, is characterized in that the pivot guide is spherical. The spherical pivot guide is of particular advantage when the pinching disc is to pivot about two different pivot axes during a revolution of the drive shaft.

A further embodiment of the depilation apparatus according to the invention, which provides a simple and practical construction of the pinching disc and the drive shaft, is characterized in that the drive shaft comprises at least three parallel rods, the coupling member being fastened to the pinching disc and arranged between the rods, while the coupling member bears on each rod with a lateral surface which forms part of a spherical surface tangent to each rod. In this embodiment, the pinching disc is closed in between the rods substantially without play in radial directions relative to the drive shaft.

A yet further embodiment of the depilation apparatus according to the invention, in which the pinching disc is supported by the rods in a stable manner in every direction perpendicular to the drive shaft, is characterized in that the drive shaft is provided with three parallel rods which, seen in a plane perpendicular to the rods, are arranged in an equilateral triangle.

A special embodiment of the depilation apparatus according to the invention is characterized in that the drive shaft is provided with four parallel rods which, seen in a plane perpendicular to the rods, are arranged in a square. In this embodiment it is possible to use entirely identical pinching discs which are coupled to the drive shaft in consecutive positions which are mutually rotated about the drive shaft through 180° or 90°.

A further embodiment of the depilation apparatus according to the invention, which provides a stiff fastening of the coupling member to the pinching disc, is characterized in that each rod of the drive shaft extends with clearance through a separate window of the pinching disc adjacent the lateral surface with which the coupling member bears on the relevant rod. In this embodiment, the pinching disc is taken along by the rotation of the drive shaft in that at least one of the rods bears on an edge of the relevant window during rotation of the drive shaft.

A still further embodiment of the depilation apparatus according to the invention, in which a great tilting angle of the pinching disc relative to the drive shaft is possible, is characterized in that the windows are oval and extend in a radial direction relative to the drive shaft.

A further embodiment of the depilation apparatus according to the invention, in which the play between the pinching disc and the drive shaft in rotational direction is small, is characterized in that one of the windows of the pinching disc is smaller than the other windows of the pinching disc.

A special embodiment of the depilation apparatus according to the invention, which also provides a simple and practical construction of the pinching disc and the drive shaft, is characterized in that the coupling member is fastened to the drive shaft, while the pivotable pinching disc is guided along the rotund pivot guide of the coupling member by means of a bearing cup.

A further embodiment of the depilation apparatus according to the invention, in which the coupling member can be fastened to the drive shaft in a simple and fast manner during the manufacture of the depilation apparatus, is characterized in that the drive shaft has a polygonal cross-section, while the coupling member is provided with a channel having a corresponding cross-section, whereby the coupling member is provided around the drive shaft substantially without play.

BRIEF DESCRIPTION OF THE DRAWINGS

The invention is explained in more detail below with reference to the drawing in which.

DETAILED DESCRIPTION OF THE PREFERRED EMBODIMENTS

Figure 1:
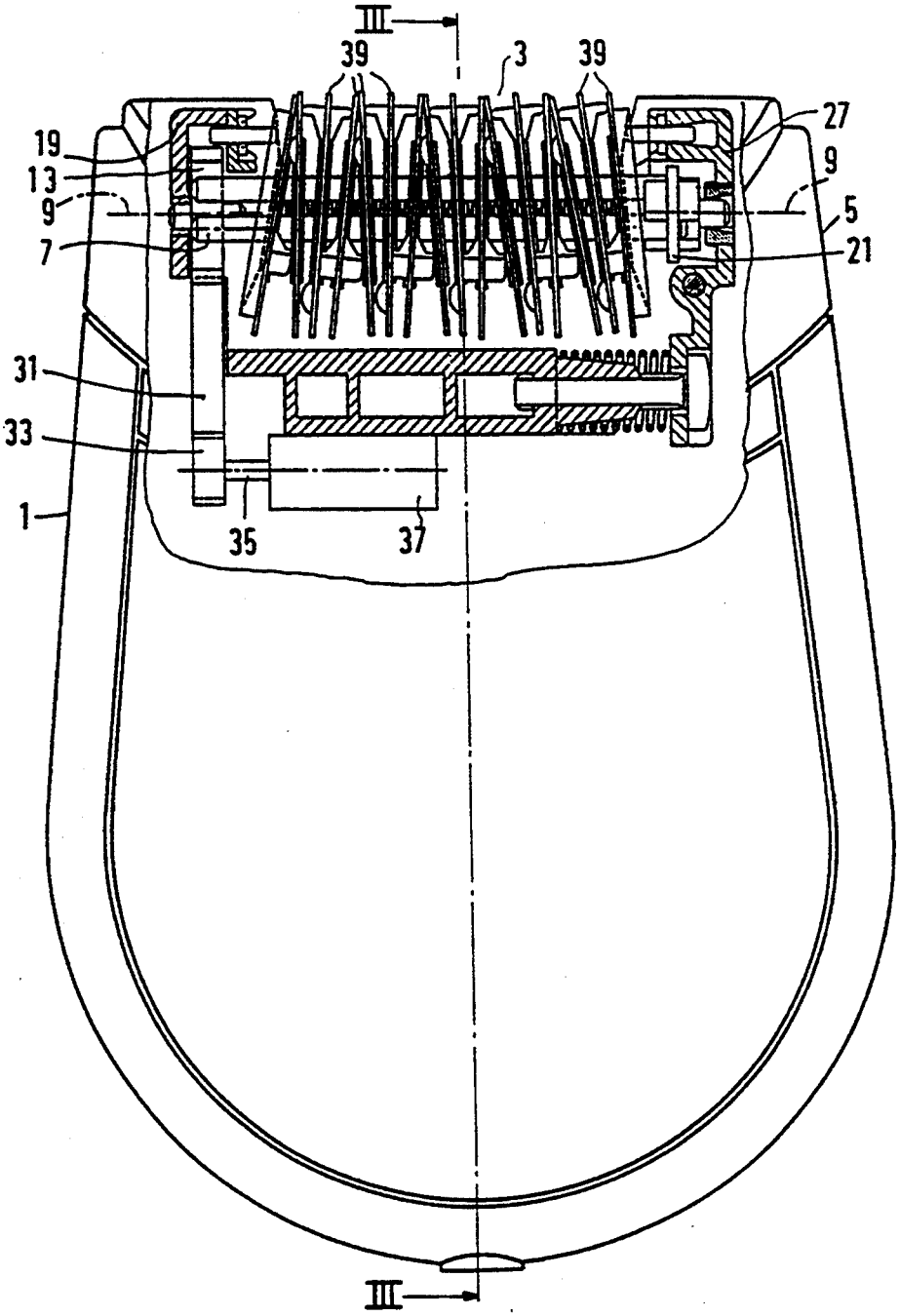
FIG. 1 is a perspective side elevation of a first embodiment of a depilation apparatus according to the invention in which a depilation head of the depilation apparatus is visible.
Figure 2:
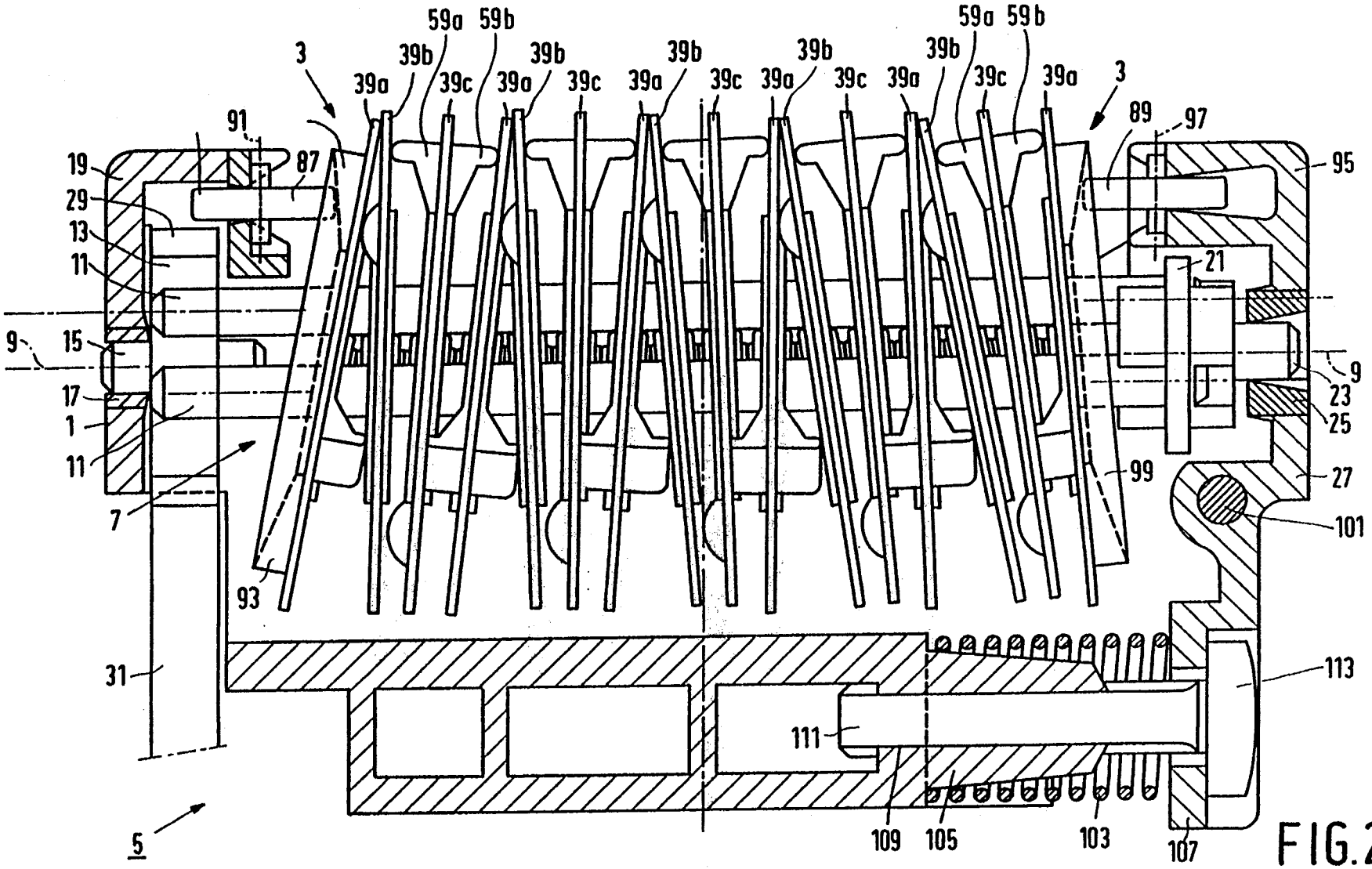
FIG. 2 shows the depilation head of the depilation apparatus of FIG. 1 in detail.
Figure 3:
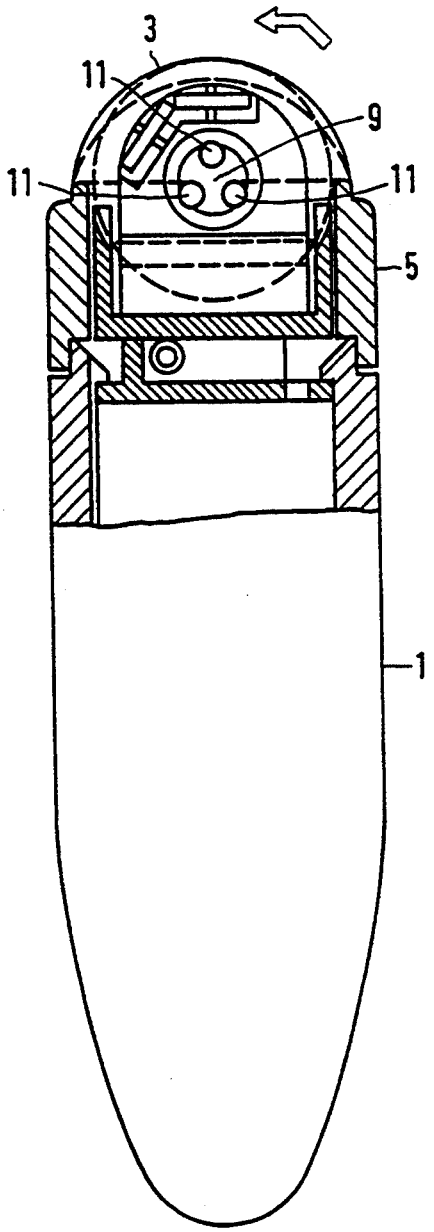
FIG. 3 is a cross-section of the depilation head of the depilation apparatus taken on the line III—III in FIG. 1.

The first embodiment of the depilation apparatus according to the invention shown in FIGS. 1 to 5 is provided with a housing 1 having a depilation opening 3 which is provided in a depilation head 5 of the housing 1. As FIGS. 1 and 2 show, a drive shaft 7 having a centerline 9 extending parallel to the depilation opening 3 is present in the depilation head 5. The drive shaft 7 is provided with three round metal rods 11 directed parallel to the centerline 9. As is shown in FIG. 3, the rods 11 are arranged in an equilateral triangle seen in a plane perpendicular to the centerline 9, the point of intersection of the centerline 9 with the said plane being situated adjacent the center of gravity of the triangle. As FIG. 2 shows in detail, the two ends of each of the three rods 11 are fastened in a first mounting disc 13, which is rotatably supported by means of a journal 15 in a bearing bush 17 of a first bearing support 19 of the housing 1, and in a second mounting disc 21 which is rotatably supported by means of a journal 23 in a bearing bush 25 of a second bearing support 27 of the housing 1. The first mounting disc 13 is provided with a toothed rim 29 which is in engagement with a toothed belt 31. As FIG. 1 shows, the toothed belt 31 is further in engagement with a pinion 33 fastened to an output shaft 35 of an electric drive motor 37 which is situated inside the housing 1 and by means of which the drive shaft 7 can be rotated.

As is shown in FIGS. 1 and 2, the depilation apparatus is further provided with a number of pinching discs 39 which are made mainly of metal, which are coupled to the drive shaft 7 so as to rotate along with it, and which are identical except for the two outermost pinching discs 39*a*. Each pair of adjacent pinching discs (39*a*, 39*b*), (39*b*, 39*c*) and (39*c*, 39*a*) is pivotable in a manner yet to be described below about a pivot axis extending transverse to the centerline 9 into a pinching position in which the two pinching discs 39 of the pair exert a pinching force on one another near the depilation opening 3. In the position of the drive shaft 7 depicted in FIG. 2, the pairs (39*a*, 39*b*) are in the pinching position, whereby hairs clamped in between the pinching discs 39*a* and 39*b* are pulled from the skin, which is exposed to the pinching discs 39 through the depilation opening 3, by rotation of the drive shaft 7. When the rotation of the drive shaft 7 continues, the pairs (39*b*, 39*c*) and the pairs (39*c*, 39*a*) will enter the pinching position in that order, as will be further discussed below, while after a full revolution of the drive shaft 7 the pairs (39*a*, 39*b*) will again enter the pinching position.

Figure 4A:
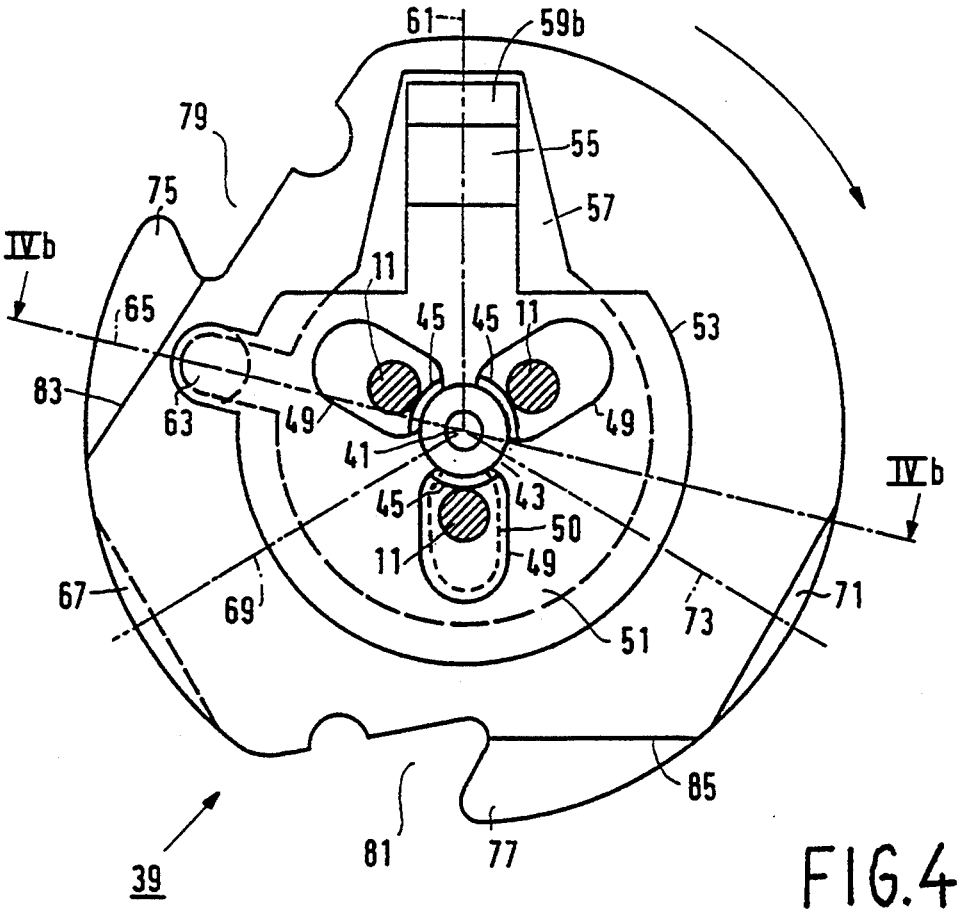
FIG. 4*a* shows a pinching disc of the depilation apparatus of FIG. 1.
Figure 4B:
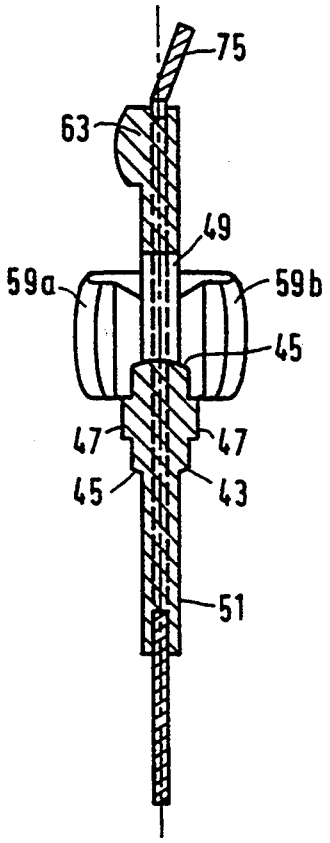
FIG. 4*b* is a cross-section of the pinching disc taken on the line IVb—IVb in FIG. 4*a*.

FIGS. 4*a* and 4*b* show a pinching disc 39 of the depilation apparatus according to FIGS. 1 and 2 in detail. The pinching disc 39 is provided near a central point 41 with a partly spherical coupling member 43 of synthetic resin which has three lateral surfaces 45 which each form part of a spherical surface common to the three lateral surfaces 45. Furthermore, the coupling member 43 comprises a projecting step 47 (see FIG. 4*b*) on either side of the pinching disc 39. The lateral surfaces 45 each adjoin an oval window 49 which extends in a radial direction relative to the central point 41, the three windows 49 being mutually positioned in a star arrangement. The coupling member 43 is positioned between the three rods 11 of the drive shaft 7 shown in cross-section in FIG. 4*a*, each lateral surface 45 of the coupling member 43 bearing on one of the rods 11. In this manner the pinching disc 39 is coupled to the drive shaft 7 substantially without play in radial directions by means of the coupling member 43. As FIG. 4*a* shows, the windows 49 are provided around the rods 11 with ample clearance, so that the pinching disc 39 has a high degree of tilting freedom relative to the drive shaft 7. The coupling member 43 itself permits of a pivoting of the pinching disc 39 about every pivot axis directed perpendicular to the centerline 9, whereby the pinching disc 39 is coupled to the drive shaft 7 substantially without play in every pivoted position thanks to the use of the spherical lateral surfaces 45. The spherical lateral surfaces 45 by which the pinching disc 39 is supported in radial directions thus act as a pivot guide for the pivoting movement of the pinching disc 39. During rotation of the drive shaft 7, furthermore, at least one of the rods 11 bears on an edge of the corresponding window 49, so that the pinching disc 39 is taken along with the rotation. The use of a separate window 49 for each rod 11 provides a stiff connection between the coupling member 43 and the pinching disc 39.

As is shown in FIG. 4*a*, it is possible in an alternative embodiment of the pinching disc 39 to construct one of the windows 49, such as the window 50 indicated by a broken line in FIG. 4*a*, so as to be smaller than the other windows 49. It is achieved in this way that the corresponding rod 11 which is passed through the window 50 always drives the pinching disc 39 into rotation, so that the play between the pinching disc 39 and the drive shaft 7 in rotational direction is comparatively small.

As is further shown in FIG. 4*a*, the coupling member 43 is integrated with an injection-molded core disc 51 of synthetic resin in which also the said windows 49 are provided. The core disc 51 is fastened in a central window 53 of the pinching disc 39 and furthermore comprises a flexible strip 55 which is present with clearance in a stud window 57 of the pinching disc 39 adjoining the central window 53 and which extends in a radial direction relative to the central point 41. The flexible strip 55 has near its end a bipartite stud 59 whose two stud parts 59*a* and 59*b* are present on either side of the pinching disc 39 (see FIG. 4*b*). The flexible strip 55 is elastically deformable in a direction transverse to the plane of the pinching disc 39, so that the bipartite stud 59 is displaceable in the said direction relative to the pinching disc 39 and can be twisted through a limited angle about a twisting axis which substantially coincides with a radius 61 of the pinching disc 39 which runs through the center of the flexible strip 55. The core disc 51 is further provided at one side with a single stud 63 (see FIG. 4*b*) which is situated on a radius 65 of the pinching disc 39, which radius encloses an angle of 75° with the radius 61 on which the bipartite stud 59 is situated.

As is further shown in FIG. 4*a*, the pinching disc 39 is provided with a first metal pinching surface 67 on the lateral surface on which the single stud 63 is present, which pinching surface is situated symmetrically relative to a radius 69 of the pinching disc 39 enclosing angles of 120° and 45° with the radii 61 and 65, respectively. On the other lateral surface of the pinching disc 39 there is a second metal pinching surface 71 which is situated symmetrically relative to a radius 73 which encloses angles of 120° with the radii 61 and 69. Seen in a direction of rotation of the pinching disc 39 indicated in FIG. 4*a*, a first nose-shaped comb 75 and a second nose-shaped comb 77 are present in front of the pinching surfaces 67 and 71, respectively, which combs adjoin a first recess 79 and a second recess 81, respectively, provided near a circumference of the pinching disc 39. The combs 75 and 77 are bent about respective bending lines 83 and 85 in directions away from the respective pinching surfaces 67 and 71. The bent comb 75 is visible in cross-section in FIG. 4*b*. The comb 77 is bent in the opposite direction.

As FIG. 2 shows, each pinching disc 39 bears with the two steps 47 of the coupling member 43 on the steps 47 of the adjoining pinching discs 39. The pinching discs 39 are thus held together as a set by means of a first and a second roller member 87 and 89. The first roller member 87 has its rotation bearings in the first bearing support 19 with an axis of rotation 91 directed transverse to the centerline 9 and bears on a stiffening plate 93 of the outermost pinching disc 39*a* near the depilation opening 3. The second roller member 89 has its rotation bearings in a pressure head 95 which is integral with the second bearing support 27, with an axis of rotation 97 directed transverse to the centerline 9, and bears on a stiffening plate 99 of the outermost pinching disc 39*a* near the depilation opening 3. The pressure head 95 together with the second bearing support 27 is rotatable about a rotation pin 101 shown in cross-section in FIG. 2 which is fastened to the housing 1 and extends transverse to the centerline 9. The second roller member 89 is pressed against the stiffening plate 99 under the influence of a pre-tensioned mechanical helical spring 103 which is arranged at a side of the drive shaft 7 facing away from the depilation opening 3 and which bears with one of its two ends on a spring holder 105 of the housing 1 and with its other end on an arm 107 of the second bearing support 27. The spring holder 105 is further provided with a drilled hole 109 in which an adjustment bolt 111 is provided. A head 113 of the adjustment bolt 111 is present at a side of the arm 107 facing away from the helical spring 103 and acts as a stop for the rotatable bearing support 27, whereby a minimum distance between the two roller members 87 and 89 is safeguarded. The pressure head 95 is displaceable substantially parallel to the drive shaft 7 by rotation of the bearing support 27 about the rotation pin 101, in which case the journal 23 is shifted in the bearing bush 25 of the second bearing support 27.

Figure 5:
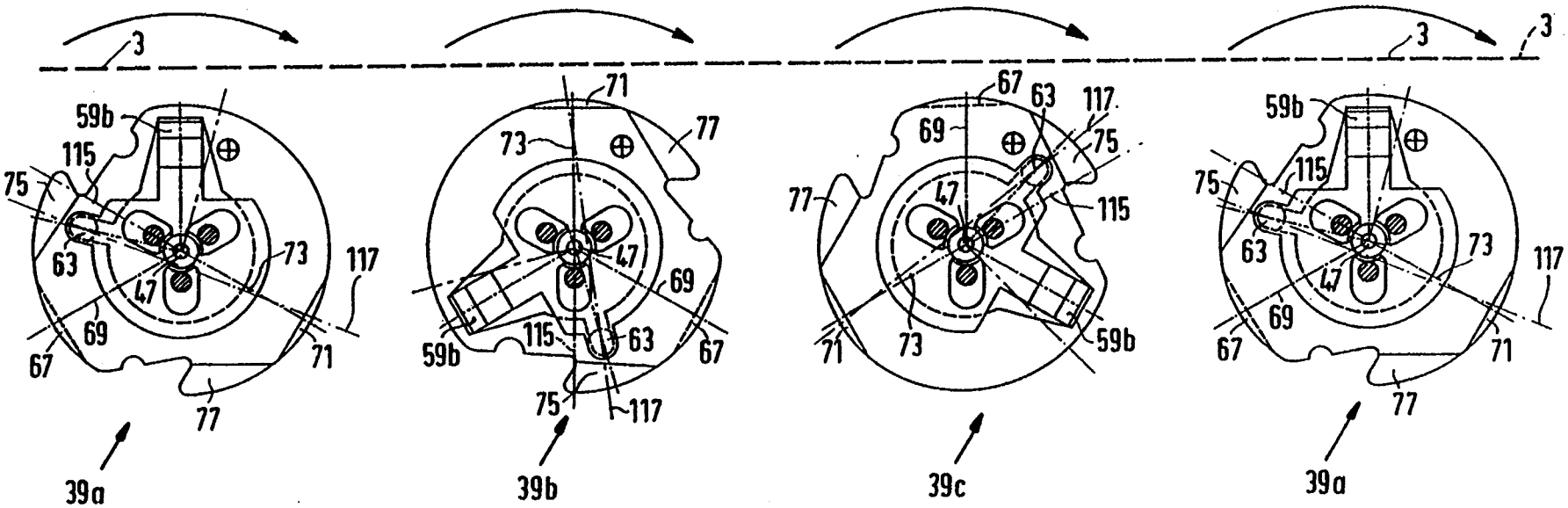
FIG. 5 shows the relative positions of four consecutive pinching discs of the depilation apparatus of FIG. 1.

FIG. 5 shows four consecutive pinching discs 39 coupled to the drive shaft 7. The single stud 63 of the pinching discs 39 are directed towards the first mounting disc 13. FIG. 5 shows that the positions in which the consecutive pinching discs 39 are coupled to the drive shaft 7 are mutually rotated through angles of 120°. Thus the second pinching surface 71 of the pinching disc 39*a* and the first pinching surface 67 of the pinching disc 39*b* form a pair of cooperating pinching surfaces 71, 67, the second nose-shaped comb 77 of the pinching disc 39*a* and the first nose-shaped comb 75 of the pinching disc 39*b* forming a hair-trapping funnel which precedes the pair of cooperating pinching surfaces 71, 67, seen in the direction of rotation of the pinching discs 39. Similarly, the second pinching surface 71 of the pinching disc 39*b* and the first pinching surface 67 of the pinching disc 39*c* form a pair of cooperating pinching surfaces 71, 67, while also the second pinching surface 71 of the pinching disc 39*c* and the first pinching surface 67 of the pinching disc 39*a* form a pair of cooperating surfaces 71, 67. All pinching discs 39, except for the two outermost pinching discs 39*a*, thus cooperate with both their adjoining pinching discs 39.

It is further visible from FIG. 5 that the point of contact by which the stud part 59*b* of the pinching disc 39*a* bears on the pinching disc 39*b* and the point of contact of the abutting steps 47 of the pinching discs 39*a* and 39*b* together define a pivot axis 115 of the pair of cooperating pinching discs 39*a*, 39*b*, which is shown on the pinching disc 39*b* in FIG. 5 and which in projection coincides substantially with the radius 73 of the second pinching surface 71 of the pinching disc 39*b*. Thus the point of contact of the stud part 59*b* of the pinching disc 39*b* and the point of contact of the steps 47 of the pinching discs 39*b* and 39*c* also define a pivot axis 115 of the pair of pinching discs 39*b*, 39*c*, which in projection coincides substantially with the radius 73 of the second pinching surface 71 of the pinching disc 39*c* (see pinching disc 39*c* in FIG. 5). The point of contact of the stud part 59*b* of the pinching disc 39*c*, finally, and the point of contact of the steps 47 of the pinching discs 39*c* and 39*a* together define a pivot axis 115 of the pair of cooperating pinching discs 39*c*, 39*a*, which in projection coincides substantially with the radius 73 of the second pinching surface 71 of the pinching disc 39*a* (see pinching disc 39*a* in FIG. 5).

The joint action of the pinching discs 39*a* and 39*b* will be described in the following passage. The joint action of the pinching discs 39*b* and 39*c* and of the pinching discs 39*c* and 39*a* takes place in an identical manner. The symbols ⓧ on the pinching discs 39 in FIG. 5 indicate the so-called pressure points at which a line of force between the points of contact by which the roller members 87 and 89 bear on the stiffening plates 93 and 99 intersects the consecutive pinching discs 39. The pinching discs 39 move along the pressure points (x) with their circumferences during rotation of the drive shaft 7. If the pressure point (x) and the pinching surfaces 71, 67 of the pinching discs **39*a*, 39*b* are on opposing sides of the pivot axis 115, the pinching discs 39*a* and 39*b* are kept at a distance away from one another by the stud part 59*a* of the pinching disc 39*b*. Between the pinching surfaces 71, 67 of the pinching discs 39*a*, 39*b* there is then a hair-trapping slot which hairs can enter when the pinching surfaces 71, 67 come near the depilation opening 3 during rotation. The moment the pivot axis 115 of the pinching discs 39*a*, 39*b* has passed the pressure point (x), the pinching discs 39*a*, 39*b* are pivoted about their pivot axis 115 under the influence of the roller members 87 and 89, upon which the pinching discs 39*a*, 39*b* are still kept at a distance away from one another temporarily by the single stud 63 (delaying stud) of the pinching disc 39*b*, which has a smaller height than the stud part 59*b* of the pinching disc 39*a*. A hair-trapping slot of reduced width remains present between the pinching surfaces 71, 67, which considerably reduces the risk of skin irritation and skin damage. As is shown on the pinching disc 39*b* in FIG. 5, the point of contact of the stud part 59*b* of the pinching disc 39*a* and the point of contact of the single stud 63 of the pinching disc 39*b* together define a further pivot axis 117. After the pivot axis 117 has also passed the pressure point (x), the pinching discs 39*a*, 39*b* are pivoted about the pivot axis 117 into the pinching position, and a quick build-up of a pinching force between the cooperating pinching surfaces 71, 67 takes place near the depilation opening 3. This pinching force reaches a maximum value when the radii 73 and 69 of the pinching discs 39*a* and 39*b* pass the pressure point (x). This position of the pinching discs 39 is depicted in FIG. 2, from which it is evident that the pinching surface 71 of the pinching disc 39*a* is in that case supported by the stud part 59*b* of the pinching disc 39*c* (not visible in FIG. 5) adjoining the pinching disc 39*a*, while the pinching surface 67 of the pinching disc 39*b* is supported by the stud part 59*a* of the pinching disc 39*c* adjoining the pinching disc 39*b*. Thus a substantially straight force transmission path running parallel to the depilation opening 3 is created between the two roller members 87 and 89 near the depilation opening 3, the pinching force exerted by the consecutive pairs of pinching discs 39*a*, 39*b* on one another being transmitted through the bipartite studs 59 (force transmission studs) of the interposed pinching discs 39*c*. An optimal value of the pinching force is obtained by this. After the radii 73 and 69 have passed the pressure point (x), the pinching force gradually drops. The pivot axis 115 then again passes the pressure point (x), after which the pinching discs 39*a*, 39*b* are again spaced apart. It is noted that the coupling members 43 of the pinching discs 39*a* and 39*b* are shifted apart over a small distance in axial direction during pivoting of the pinching discs 39*a* and 39*b* about the further pivot axis 117 into the pinching position, so that the steps 47 of the pinching discs 39*a* and 39*b* do not abut in the pinching position of the pinching discs 39*a* and 39*b***.

The joint action of the pinching discs **39*b* and 39*c* and of the pinching discs 39*c* and 39*a* takes place in an identical manner, the pivoting movements of the pinching discs 39*a*, 39*b*, the pinching discs 39*b*, 39*c*, and the pinching discs 39*c*, 39*a* taking place with interspacings corresponding to a rotation of the drive shaft 7 through 120° each time. Starting from the situation shown in FIG. 2, accordingly, the pinching discs 39*b* and 39*c* enter the pinching position after the drive shaft 7 has rotated 120° further, whereby the pinching surfaces 71, 67 of the pinching discs 39*b*, 39*c* are supported on either side by the bipartite studs 59 of the pinching discs 39*a*. After this, after the drive shaft has again rotated 120° further, the pinching discs 39*c* and 39*a* enter the pinching position, whereby the pinching surfaces 71, 67 of the pinching discs 39*c*, 39*a* are supported on either side by the bipartite studs 59 of the pinching discs 39*b***.

The distance between the two roller members 87 and 89 fluctuates slightly during a revolution of the drive shaft 7. In the position of the drive shaft 7 shown in FIG. 2, in which the pinching discs **39*a*, 39*b* are in the pinching position and the pinching discs 39*b* and 39*c* as well as the pinching discs 39*c* and 39*a* are kept apart from one another by the bipartite studs 59 of the pinching discs 39*c*, the distance between the two roller members 87 and 89 is at its maximum. A similar situation occurs in a position of the drive shaft 7 in which the pinching discs 39*b*, 39*c* or the pinching discs 39*c*, 39*a* are in the pinching position. In the intermediate positions of the drive shaft 7 there are no bipartite studs 59 near the depilation opening 3, so that the pinching discs 39 are pressed together further by the roller members 87, 89. To prevent the pinching discs 39 being compressed too far, which would lead to an unnecesary wear of the roller members 87, 89 and the stiffening plates 93, 99 and to an unnecessary power consumption of the drive motor 37, the housing 1 is provided with the adjustment bolt 111 referred to above, whose head 113 serves as a stop for the pressure head 95. Owing to the use of the said stop, the roller members 87, 89 do not exert a compression force on the stiffening plates 93 and 99 in the said intermediate positions of the drive shaft 7**.

Furthermore, due to the use of the flexible strip 55 by which the bipartite stud 59 is coupled to the pinching disc 39, the bipartite stud 59 has some freedom of movement relative to the pinching disc 39 when the bipartite stud 59 is clamped between the pinching surfaces 67, 71 of the adjoining pinching discs 39 near the depilation opening 3. Shifting of the bipartite stud 59 over the pinching surfaces 67, 71 and an accompanying wear of the bipartite stud 59 are prevented as much as possible in this way. This shifting could occur inter alia as a result of differences in tilting speed between the consecutive pinching discs 39.

FIG. **6*a* shows a pinching disc 119 of a second embodiment of the depilation apparatus according to the invention which has the same general construction as the depilation apparatus according to the first embodiment. In the second embodiment, however, the drive shaft 7 of the depilation apparatus has four round rods 121 directed parallel to the depilation opening 3, shown in FIG. 6*a* in cross-section. The four rods 121 are arranged in a square, seen in a plane perpendicular to the centerline 9 of the drive shaft 7. The pinching disc 119 is coupled to the drive shaft 7 substantially without play in radial directions by means of a disc-shaped coupling member 123 which is arranged between the four rods 121 and is provided with four lateral surfaces 125 which each form part of a spherical surface common to the four lateral surfaces 125 and which each bear on one of the rods 121. The coupling member 123** is visible in cross-section in FIG. 6*b*. The rods 121 are each present with ample clearance in a separate, oval window 127 of the pinching disc 119.

Figure 6A:
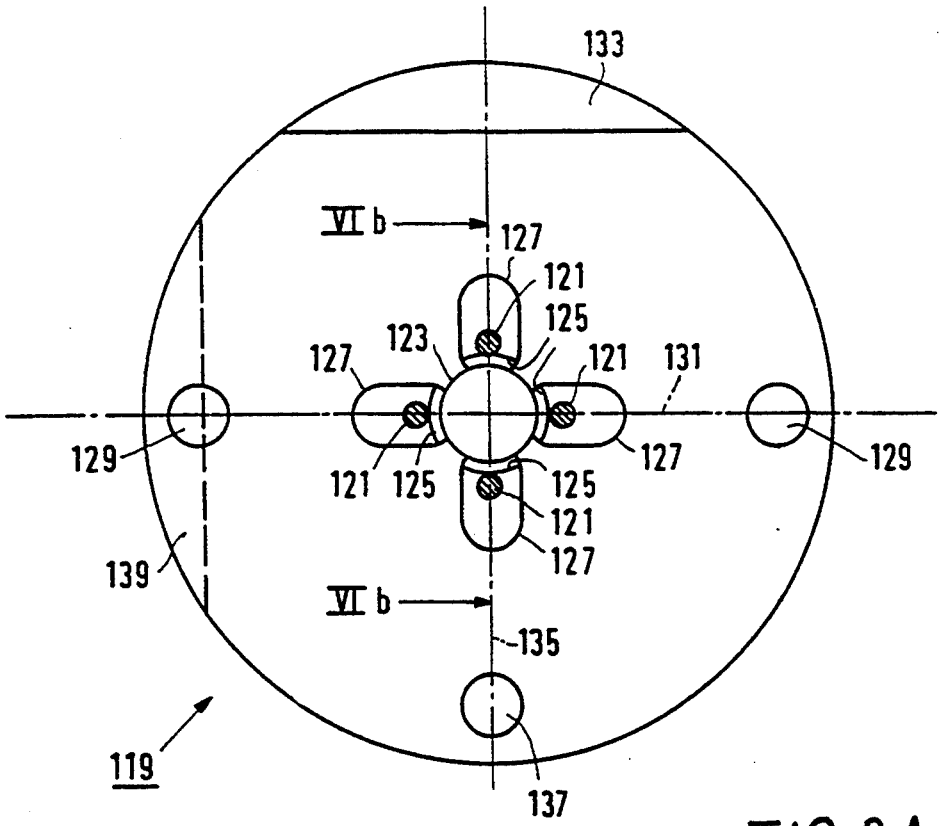
FIG. 6*a* shows a pinching disc of a second embodiment of the depilation apparatus.
Figure 6B:
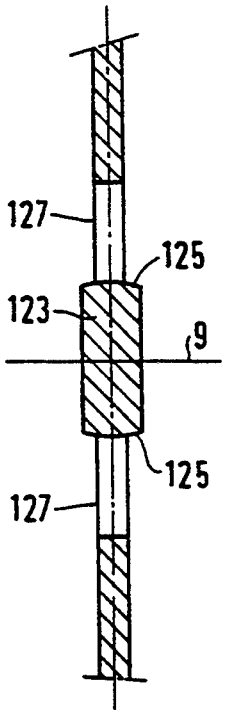
FIG. 6*b* is a cross-section of the pinching disc taken on the line VIb—VIb in FIG. 6*a*.

As is further indicated in FIG. 6*a*, the pinching disc 119 is provided on one of its two lateral surfaces with two pivot studs 129 which are mutually diametrically opposed on a centerline 131 of the pinching disc 119, a first pinching surface 133 arranged symmetrically relative to a centerline 135 which is perpendicular to the centreline 131, and a force transmission stud 137 which is arranged on the centerline 135 diametrically opposite the first pinching surface 133. On the other lateral surface, the pinching disc 119 is provided with a second pinching surface 139 which is symmetrically arranged relative to the centerline 131 near one of the pivot studs 129.

Figure 7:
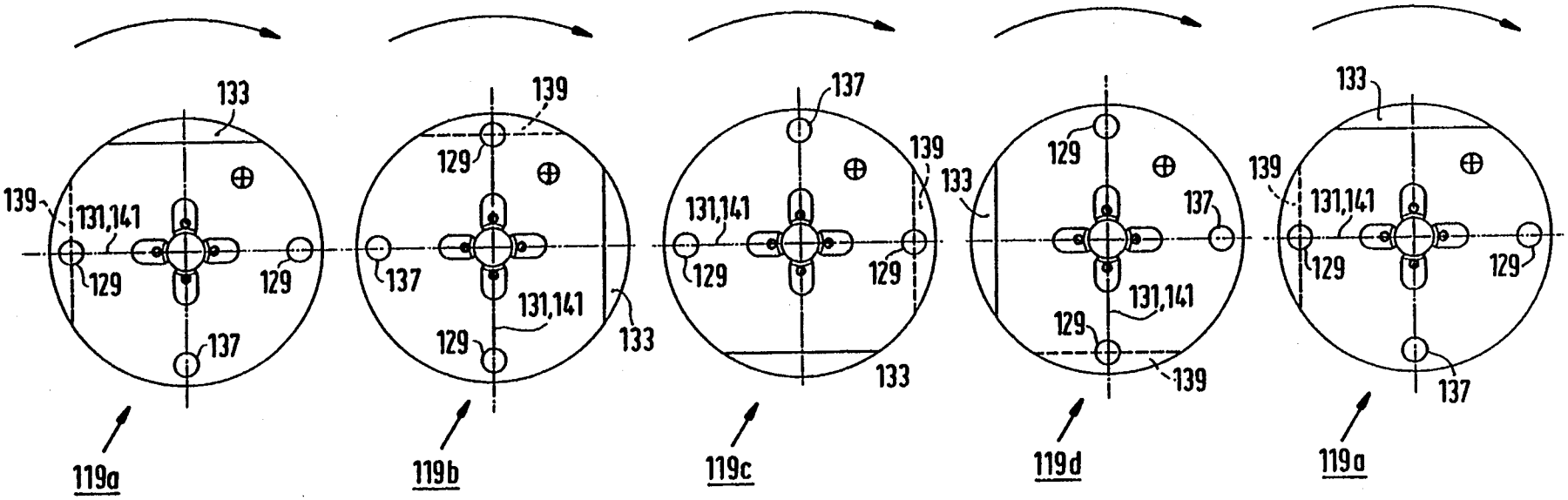
FIG. 7 shows the relative positions of five consecutive pinching discs according to FIGS. 6*a* and 6*b*.

FIG. 7 shows that the positions in which the consecutive pinching discs 119 are coupled to the drive shaft 7 are mutually rotated through 90° about the drive shaft. Thus the first pinching surfaces 133 of the pinching discs 119*a*, 119*b*, 119*c* and 119*d* are in cooperation with the second pinching surfaces 139 of the pinching discs 119*b*, 119*c*, 119*d* and 119*a*, respectively. The pairs of pinching discs (119*a*, 119*b*), (119*b*, 119*c*), (119*c*, 119*d*) and (119*d*, 119*a*) are kept removed from one another in axial direction by the two pivot studs 129 of the pinching discs 119*a*, 119*b*, 119*c* and 119*d*, respectively. The points of contact by which the pivot studs 129 of the pinching disc 119*a* bear on the pinching disc 119*b* define a pivot axis 141 of the pair of pinching discs 119*a*, 119*b*, which axis is indicated in FIG. 7 on the pinching disc 119*a* and which in projection coincides with the centerline 131 of the pinching disc 119*a*. Thus the pairs of pinching discs (119*b*, 119*c*), (119*c*, 119*d*) and (119*d*, 119*a*) each have a pivot axis 141 defined by the pivot studs 129 of the pinching discs 119*b*, 119*c* and 119*d*, respectively. If the pressure point (x) and the pinching surfaces 133, 139 of the pinching discs 119*a*, 119*b* are on opposing sides of the pivot axis 141, the pinching discs 119*a*, 119*b* are kept at a distance from one another by the force transmission stud 137 of the pinching disc 119*a*, and a hair-trapping slot is present between the pinching surfaces 133, 139. The moment the pivot axis 141 has passed the pressure point (x), the pinching discs 119*a*, 119*b* are tilted into the pinching position, whereby the pinching surfaces 133, 139 exert a pinching force on one another and are supported on either side by one of the pivot studs 129 of the adjoining pinching disc 135*d* and one of the pivot studs 129 of the pinching disc 119*b*. The force transmission stud 137 of the pinching disc 119*c* is then between these two pivot studs 129, so that a straight force transmission path is again created near the depilation opening 3 and an optimal pinching force between the pinching surfaces 133, 139 is provided. The pinching discs 119*a*, 119*b* are again spaced apart from one another when the pivot axis 141 subsequently passes the pressure point (x) again. The cooperation between the pinching discs 119*b* and 119*c*, between the pinching discs 119*c* and 119*d* and between the pinching discs 119*d* and 119*a* takes place in an identical manner, the tilting movements of the pinching discs 119*a*, 119*b*, the pinching discs 119*b*, 119*c*, the pinching discs 119*c*, 119*d*, and the pinching discs 119*d*, 119*a* taking place consecutively with interspacings corresponding to a rotation of the drive shaft 7 through 90° each time. Starting from a position of the drive shaft 7 in which the pinching discs 119*a*, 119*b* are in the pinching position near the depilation opening 3, accordingly, the pinching discs 119*b* and 119*c* enter the pinching position after the drive shaft 7 has rotated 90° further, whereby the pinching surfaces 133, 139 of the pinching discs 119*b*, 119*c* are supported on either side by one of the pivot studs 129 of the interposed pinching discs 119*a* and one of the pivot studs 129 of the pinching discs 119*c* and whereby a force transmission stud 137 of one of the interposed pinching discs 119*d* is present each time between these pivot studs 129. After this, when the drive shaft 7 has again rotated 90° further, the pinching discs 119*c* and 119*d* enter the pinching position, whereby the pinching surfaces 133, 139 of the pinching discs 119*c*, 119*d* are supported on either side by one of the pivot studs 129 of the interposed pinching discs 119*b* and one of the pivot studs 129 of the pinching discs 119*d* and whereby the force transmission stud 137 of one of the interposed pinching discs 119*a* is present between these pivot studs 129 each time. Finally, after the drive shaft 7 has rotated through another 90°, the pinching discs 119*d* and 119*a* enter the pinching position. The pinching surfaces 133, 139 of the pinching discs 119*d*, 119*a* are then supported by one of the pivot studs 129 of the interposed pinching discs 119*c* and one of the pivot studs 129 of the pinching discs 119*a*. The force transmission stud 137 of one of the interposed pinching discs 119*b* is then situated between these pivot studs 129 each time.

It is evident from FIG. 7 that it is possible to use identical pinching discs 119 in the second embodiment of the depilation apparatus, in which the pinching discs 119 are rotated through 90° about the drive shaft 7 each time, because the drive shaft 7 is provided with the four rods 121. It is also possible to use identical pinching discs in an alternative embodiment, in which the pinching discs are rotated through 180° about the drive shaft 7 each time, if the drive shaft 7 is provided with four rods 121.

Figure 8:
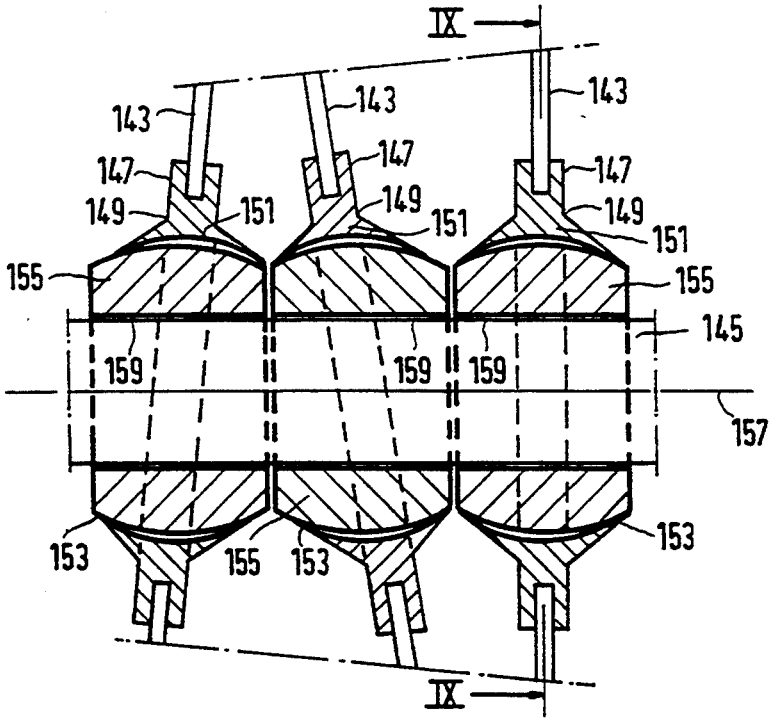
FIG. 8 is a longitudinal section of a shaft coupling of a pinching disc according to a third embodiment of the depilation apparatus.
Figure 9:
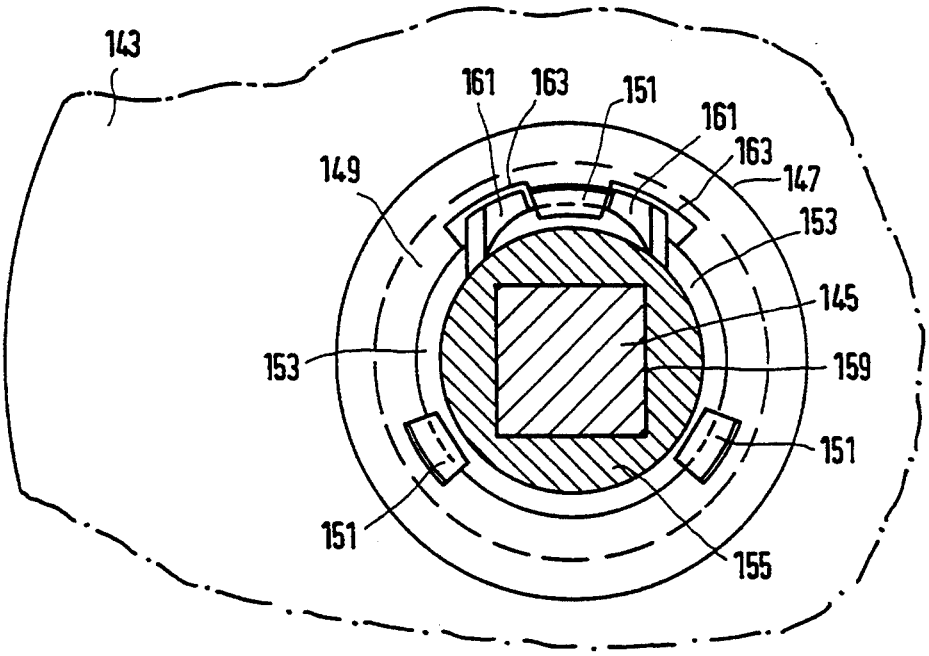
FIG. 9 is a cross-section of the shaft coupling taken on the line IX—IX, in FIG. 8.
Figure 10:
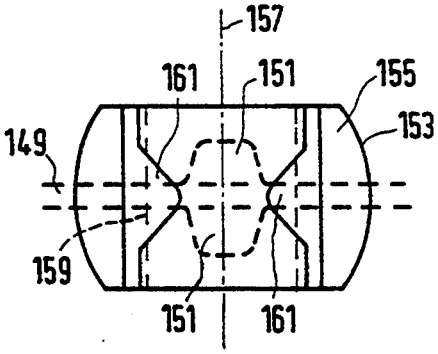
FIG. 10 is a plan view of a coupling member of the shaft coupling of FIG. 8.

FIGS. 8 to 10 show how three consecutive pinching discs 143 of a third embodiment of the depilation apparatus according to the invention are coupled to a drive shaft 145 of the depilation apparatus. The pinching discs 143 are almost identical to the pinching discs 39 of the first embodiment of the depilation apparatus, however, the pinching discs 143 each comprise a core disc 147 with an annular bearing cup 149 made of synthetic resin. The bearing cup 149 is provided with three bearing feet 151 which are positioned in a star arrangement in the plane of the pinching disc 143 and which each extend on either side of the bearing cup 149 (see FIGS. 8 and 9). The pinching discs 143 are each guided over a spherical surface 153 of a coupling member 155 substantially without play by means of the bearing feet 151. Thus the pinching disc 143 is in principle pivotable relative to the coupling member 155 about any pivot axis which is perpendicular to the centreline 157 of the drive shaft 145.

As is shown in FIG. 9, the drive shaft 145 has a square cross-sectional profile. The coupling members 155 each have a channel 159 with a cross-section corresponding to the profile of the drive shaft 145. The coupling members 155 with the pinching discs 143 are provided around the drive shaft 145 without play by means of the channels 159 and are coupled to the drive shaft 145 so as to rotate along with it. As FIGS. 9 and 10 further show, the coupling members 155 each comprise two wedge-shaped carrier lugs 161 between which one of the bearing feet 151 of the relevant pinching disc 143 is situated with clearance. During rotation of the drive shaft 145, one of the carrier lugs 161 bears on this bearing foot 151, so that the pinching disc 143 is taken along with the rotation of the drive shaft 145. The two carrier lugs 161 are each positioned in a recess 163 of the relevant bearing cup 149. During manufacture of the depilation apparatus, the pinching discs 143 may be coupled to the coupling members 155 in a simple manner under elastic deformation of the bearing feet 151, after which the coupling members 155 with the pinching discs 143 are passed over the drive shaft 145 into their consecutive positions.

It is noted that the spherical lateral surfaces 45, 125 and 153 of the coupling members 43, 123 and 155 described above each act as a pivot guide. The use of these spherical pivot guides renders tilting of the pinching discs 39, 119 and 143 about two different pivot axes possible, so that a construction of the depilation apparatus is possible in which the consecutive pinching discs 39, 119, 143 are rotated through mutual angles of 120° or 90° about the drive shaft 7, 145. In an alternative embodiment of the depilation apparatus, in which the pinching discs are rotated through mutual angles of 180° about the drive shaft, a tilting of the pinching discs about only one pivot axis is necessary, and a cylindrical pivot guide may be used instead of a spherical pivot guide. Accordingly, the ten "rotund" in the above description is to be understood to mean either spherical or cylindrical.

It is further noted that the first roller member 87 and the second roller member 89 provided in the pressure head 95 together form a pivot member by means of which the pinching discs 39, 119 are pivotable relative to the drive shaft 7. The coupling of the pinching discs 39, 119 to the drive shaft 7 described above can also be used in depilation apparatuses which are provided with an alternative pivot member for pivoting the pinching discs. Thus in the depilation apparatus mentioned in the introduction, which is known from U.S. Pat. No. 4,960,422, a drive shaft having four parallel rods could be used, whereby the four sliding bars required for this known depilation apparatus could be integrated with the four rods. A drive shaft having three or four parallel rods may also be used in the depilation apparatus known from German Patent Application DE 3930884 A1. In this depilation apparatus, the pinching discs are pivotable by means of spreader rollers which are rotatable about an auxiliary shaft running parallel to the drive shaft.

The drive shaft 7 of the first embodiment of the depilation apparatus shown in FIGS. 1 to 5 further comprises three parallel rods 11 which are arranged in a plane perpendicular to the centerline 9 in an equilateral triangle. It is noted that the three rods 11 may also be arranged in an irregular triangle. This, however, in general leads to a less stable coupling of the pinching discs 39 to the drive shaft 7 and a less simple construction of the mounting discs 13 and 21.

It is further noted that the drive shaft 7 may also comprise more than four rods 11. This in general leads to a more stable and rigid coupling of the pinching discs 39, 119 to the drive shaft 7. A disadvantage is that the construction of the mounting discs 13 and 21 becomes less simple, while also the space available for providing the connection between the coupling member 43, 123 and the pinching disc 39, 119 is reduced.

As was described in the above, the pinching discs 39, 119 are taken along by the rotation of the drive shaft 7 in that at least one of the rods 11 bears on the edge of the associated window 49, 127 during rotation of the drive shaft 7. It is noted, finally, that the connection between the coupling member 43, 123 and the pinching disc 39, 119 may also be effected in an alternative manner, for example, by means of round spokes or flat strips which extend in radial direction relative to the center 41 of the pinching disc 39, 119. At least one of the rods 11 then bears on the associated spoke or strip during rotation of the drive shaft 7.

We claim:

1. A depilation apparatus having a housing with a drive shaft attached thereto, means for rotating the drive shaft, and at least two adjoining cooperating pinching discs which are coupled to the drive shaft which is rotatable relative to the housing and which extends parallel to a depilation opening of the housing, each of the at least two pinching discs being pivotable about a pivot axis directed transverse to the drive shaft into a pinching position in which the pinching discs exert a pinching force on one another near the depilation opening, wherein each pivotable pinching discs is supported in a direction transverse to the drive shaft by means of a rotund pivot guide of a coupling member by which the pinching discs are coupled to the drive shaft substantially without play in radial directions in every position.

2. A depilation apparatus as claimed in claim 1, wherein each pivot guide is a plurality of spherical surfaces of its corresponding coupling member.

3. A depilation apparatus as claimed in claim 2 wherein each coupling member is fastened to the drive shaft, while one of the pivotable pinching disc is guided along the rotund pivot guide of each coupling member by means of a bearing cup.

4. A depilation apparatus as claimed in claim 1, wherein the drive shaft comprises at least three parallel rods, each coupling member being fastened to one as the pinching discs and arranged between the rods, while each coupling member bears on each rod with a lateral surface which forms part of a spherical surface tangent to each rod.

5. A depilation apparatus as claimed in claim 4, wherein said three parallel rods when are arranged in an equilateral triangle.

6. A depilation apparatus as claimed in claim 5 wherein each rod of the drive shaft extends with clearance through a separate window of each pinching disc adjacent the lateral surface with which each coupling member bears on one of the parallel rods.

7. A depilation apparatus as claimed in claim 4, wherein the drive shaft is provided with four parallel rods which, seen in a plane perpendicular to the rods, are arranged in a square.

8. A depilation apparatus as claimed in claim 7 wherein each rod of the drive shaft extends with clearance through a separate window of each pinching disc adjacent the lateral surface with which each coupling member bears on one of the parallel rods.

9. A depilation apparatus as claimed in claim 4, wherein each rod of the drive shaft extends with clearance through a separate window of each pinching disc adjacent the lateral surface with which each coupling member bears on the relevant parallel rod.

10. A depilation apparatus as claimed in claim 9, wherein the windows are oval and extend in a radial direction relative to the drive shaft.

11. A depilation apparatus as claimed in claim 10 wherein one of the windows of each pinching disc is smaller than the other windows of each pinching disc.

12. A depilation apparatus as claimed in claim 9, wherein one of the windows of the pinching disc is smaller than the other windows of each pinching disc.

13. A depilation apparatus as claimed in claim 1, wherein each coupling member is fastened to the drive shaft, while each pivotable pinching disc is guided along the rotund pivot guide of each coupling member by means of a bearing cup.

14. A depilation apparatus as claimed in claim 13, wherein the drive shaft has a polygonal cross-section, while each coupling member is provided with a channel having a corresponding cross-section, whereby each coupling member is provided around the drive shaft substantially without play.

15. A depilation apparatus having a housing with a drive shaft attached thereto, means for rotating the drive shaft, and at least two adjoining cooperating pinching discs which are coupled to the drive shaft which is rotatable relative to the housing and which extends parallel to a depilation opening of the housing, at least one of the pinching discs being pivotable about a pivot axis directed transverse to the drive shaft into a pinching position in which the pinching discs exert a pinching force on one another near the depilation opening, wherein the at least one pivotable pinching disc are supported in a direction transverse to the drive shaft by means of a rotund pivot guide of a coupling member by which the at least one pinching disc is coupled to the drive shaft and the drive shaft comprises at least three parallel rods, said coupling member being fastened to the at least one pinching disc and arranged between the rods and bearing on each rod with a surface which forms part of a spherical surface tangent to each rod.

* * * * *